US008286840B2

(12) United States Patent
Jacuk

(10) Patent No.: US 8,286,840 B2
(45) Date of Patent: Oct. 16, 2012

(54) FLUID PRODUCT DISPENSING VALVE

(75) Inventor: Christophe Jacuk, Le Vaudreuil (FR)

(73) Assignee: Aptar France SAS, Le Neubourg (FR)

( * ) Notice: Subject to any disclaimer, the term of this patent is extended or adjusted under 35 U.S.C. 154(b) by 1335 days.

(21) Appl. No.: 11/915,093

(22) PCT Filed: May 18, 2006

(86) PCT No.: PCT/FR2006/050454

§ 371 (c)(1),
(2), (4) Date: Nov. 20, 2007

(87) PCT Pub. No.: WO2007/000536

PCT Pub. Date: Jan. 4, 2007

(65) Prior Publication Data

US 2008/0190967 A1 Aug. 14, 2008

(30) Foreign Application Priority Data

May 20, 2005 (FR) ..... 05 51319

(51) Int. Cl.
*B65D 83/00* (2006.01)

(52) U.S. Cl. ..... 222/402.2; 222/402.1; 222/402.24

(58) Field of Classification Search ..... 222/394, 222/402.1, 402.2, 402.24, 402.25
See application file for complete search history.

(56) References Cited

U.S. PATENT DOCUMENTS

| | | | | | |
|---|---|---|---|---|---|
| 3,158,326 | A | * | 11/1964 | Remane | 239/573 |
| 3,190,508 | A | | 6/1965 | Petersen | |
| 3,272,403 | A | * | 9/1966 | Alexander | 222/402.1 |
| 3,352,464 | A | | 11/1967 | Frangos | |
| 3,385,482 | A | * | 5/1968 | Frangos | 222/402.2 |
| 3,613,964 | A | * | 10/1971 | Gronemeyer et al. | 222/402.24 |
| 3,664,557 | A | * | 5/1972 | Bruce | 222/397 |
| 3,675,832 | A | * | 7/1972 | Ruscitti | 222/402.24 |
| 4,062,478 | A | * | 12/1977 | Giuffredi | 222/402.16 |
| 4,503,999 | A | * | 3/1985 | MacNair et al. | 222/402.16 |
| 4,953,759 | A | | 9/1990 | Schmidt | |
| 6,131,777 | A | * | 10/2000 | Warby | 222/402.2 |
| 2002/0020721 | A1 | * | 2/2002 | Bonningue et al. | 222/402.1 |
| 2003/0194379 | A1 | | 10/2003 | Brugger et al. | |

FOREIGN PATENT DOCUMENTS

| | | |
|---|---|---|
| EP | 0 801 009 A1 | 10/1997 |
| FR | 2 076 684 A | 10/1971 |
| GB | 2 206 100 A | 12/1988 |

* cited by examiner

*Primary Examiner* — Kevin P Shaver
*Assistant Examiner* — Daniel R Shearer
(74) *Attorney, Agent, or Firm* — Sughrue Mion, PLLC

(57) ABSTRACT

A fluid dispenser valve for mounting on a neck (2) of a receptacle (1) containing the fluid, said valve comprising a valve body (10) including a metering chamber (15) and a valve member (20) movable in said metering chamber (15) between a rest position and a dispensing position, said metering chamber (15) having a top gasket (30) and a bottom gasket (40) co-operating in leaktight manner with said valve member (20), said valve including a neck gasket (50) co-operating in leaktight manner with said valve body (10) and with said receptacle neck (2), said neck gasket (50) being made integrally as a single piece with one of said top and bottom gaskets (30, 40) of the metering chamber (15).

25 Claims, 3 Drawing Sheets

FLUID PRODUCT DISPENSING VALVE

The present invention relates to a fluid dispenser valve, and also to a fluid dispenser device including such a valve.

Fluid dispenser valves, in particular metering valves for dispensing pharmaceutical fluids in the form of aerosol sprays are well known. They generally comprise a cylindrical valve body defining a metering chamber between two gaskets, a top gasket and a bottom gasket, and a valve member slidable in leaktight manner inside said metering chamber between a rest position and a dispensing position. The valve body is fastened in a capsule, in particular by snap-fastening or crimping, with said capsule being adapted subsequently to be crimped onto the neck of a receptacle containing the fluid for dispensing. A neck gasket is interposed between the neck of the receptacle and the capsule in order to provide sealing at that level. That type of valve operates in satisfactory manner, but presents certain drawbacks. Thus, the number of component parts is large, thereby increasing the complexity of fabrication and assembly and thus increasing the cost of the valve. Furthermore, when the valve manufacturer is different from the manufacturer of the fluid for dispensing, the valve is generally delivered to the manufacturer of the fluid while fastened in the capsule but without being mounted on the neck of the receptacle, such that that mounting operation, in particular by crimping, needs to be performed subsequently on the premises of the manufacturer of the fluid. That operation is tricky and can lead to rejects being generated.

An object of the present invention is to provide a simplified valve that does not reproduce the above-mentioned drawbacks.

In particular, the present invention seeks to provide a fluid dispenser valve that comprises fewer component parts.

The present invention also seeks to provide such a valve that eliminates any assembly operation on the premises of the manufacturer of the fluid, other than filling the receptacle.

The present invention also seeks to provide a fluid dispenser valve that is simple and inexpensive to fabricate and to assemble.

The present invention thus provides a fluid dispenser valve for mounting on a neck of a receptacle containing fluid, said valve comprising a valve body including a metering chamber and a valve member movable in said metering chamber between a rest position and a dispensing position, said metering chamber having a top gasket and a bottom gasket co-operating in leaktight manner with said valve member, said valve including a neck gasket co-operating in leaktight manner with said valve body and with said receptacle neck, said neck gasket being made integrally as a single piece with one of said top and bottom gaskets of the metering chamber.

Advantageous characteristics of the invention are specified in the dependent claims.

The present invention also provides a fluid dispenser device comprising a receptacle containing the fluid together with a valve as specified above.

Advantageous characteristics of the device are specified in the dependent claims.

These and other characteristics and advantages of the present invention appear more clearly from the following detailed description of various embodiments and variants thereof, the description being made with reference to the accompanying drawings given as non-limiting examples, and in which.

Figure 1:
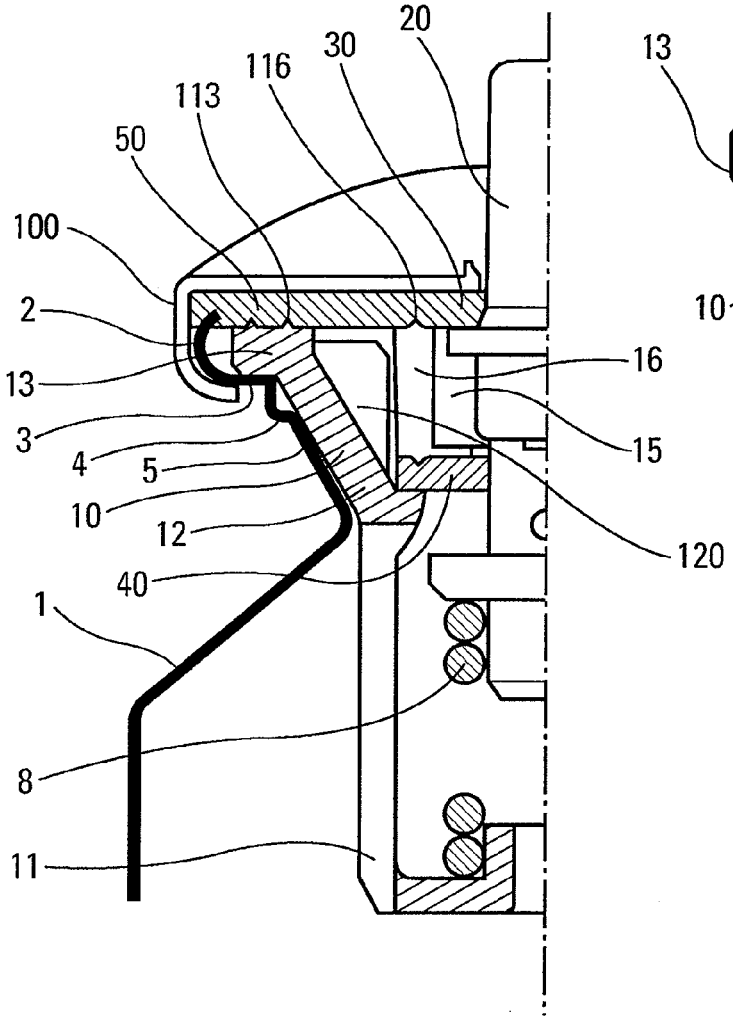
FIG. 1 is a diagrammatic view, partially in section, showing a valve in a first embodiment of the present invention.

With reference to the figures, the present invention relates in particular to a valve of the metering valve type for dispensing a medicinal fluid in the form of an aerosol by means of a propellant gas. Naturally, the present invention can also apply to valves of some other type or used in different fields, such as perfumery or cosmetics.

The valve comprises a valve body 10 having a metering chamber 15. The metering chamber 15 is advantageously formed by a hollow axial sleeve 16, the inside of which defines the metering chamber 15. A valve member 20 is slidably mounted in the metering chamber 15 to slide between a rest position and a dispensing position. The metering chamber 15 has a top gasket 30 and a bottom gasket 40 (the terms "top" and "bottom" relate to the position of the valve as shown in the figures), and the valve member 20 slides in leaktight manner between these top and bottom gaskets 30 and 40. The operation of the valve, namely filling the metering chamber 15 with the fluid coming from the receptacle, and emptying it when dispensing the measured quantity or "dose", are conventional and are not described in greater detail below. It should be observed that the present invention can be applied to any type of valve operating in any known manner.

The valve body 10 is assembled on a receptacle 1, in particular on the neck 2 of the receptacle 1, by means of a fastener member 100, which is advantageously a crimping capsule as shown in the figures. It should be observed at this point that the fastener member could be of a different type, for example it could be screw-fastenable, snap-fastenable, or the like. A neck gasket 50 is interposed between the valve body 10 and the fastener member 100, which member is referred to below as the fastener capsule for reasons of simplicity in description, said neck gasket 50 serving to provide sealing between the valve body 10, the neck of the receptacle 1, and the fastener capsule 100.

According to an aspect of the invention, the neck gasket 50 is made as a single piece either with the top gasket 30 of the metering chamber, or with the bottom gasket 40 of the metering chamber. FIGS. 1 to 4 show two embodiments in which the neck gasket 50 is made as a single piece with the top gasket 30. FIG. 5 shows an embodiment in which the neck gasket 50 is made as a single piece with the bottom gasket 40. The present invention thus makes it possible to eliminate one component part, thereby simplifying assembly and reducing costs.

Figure 2:
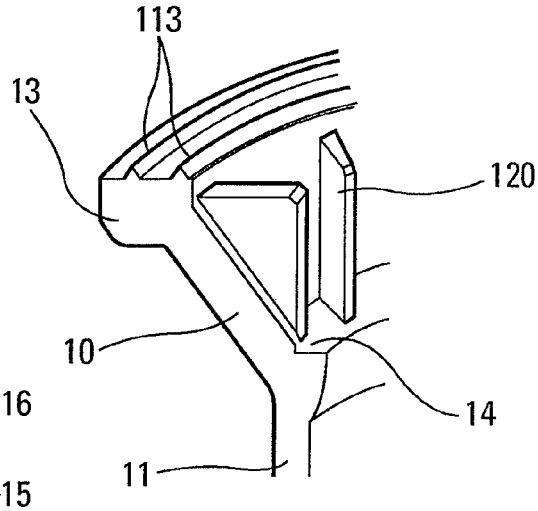
FIG. 2 is a detail view of the valve body shown in FIG. 1.

With reference initially to FIGS. 1 and 2, the neck gasket 50 is made integrally as a single piece together with the top gasket 30. It thus rests both on the axial sleeve 16 defining the metering chamber 15, and on a top surface of the valve body 10 for performing its sealing functions. Via its inside peripheral edge, it co-operates with the valve member 20 both at rest, and while it is moving. Advantageously, according to another aspect of the present invention, the valve body 10 comprises a cylindrical body portion 11, a top edge portion 13, and a frustoconical body portion 12 interconnecting said cylindrical body portion 11 and said top edge portion 13. Advantageously, and as shown in the figures, the diameter of the top edge portion 13 is greater than the diameter of the cylindrical body portion 11. In likewise advantageous manner, the outer top axial surface of the top edge 13 can be provided with a sealing profile 113, e.g. comprising at least one axial projection (two projections shown in the figures), in order to improve sealing at this level. In corresponding manner, on its outer top axial surface, the hollow axial sleeve 16 may also include a sealing profile 116, e.g. an axial projection co-operating with the top gasket 30.

As can be seen in the figures, the bottom gasket 40 of the metering chamber 15 can be located close to the junction between the cylindrical body portion 11 and the frustoconical body portion 12. Advantageously, an inwardly-directed radial shoulder 14 is provided close to this junction, the top axial surface of said shoulder 14 possibly also including a sealing profile 114, such as at least one axial projection, adapted to co-operate with the bottom gasket 40 to improve sealing.

According to yet another advantageous aspect of the invention, the frustoconical body portion 12 includes at least one inwardly-directed radial projection 120. As can be seen in the figures, said frustoconical body portion 12 advantageously includes a plurality of radial projections 120 having inner axial edges advantageously defining an inscribed geometrical cylinder of diameter slightly greater than the outside diameter of the hollow axial sleeve 16 that defines the metering chamber 15. This can be seen more clearly in FIG. 2. The presence of these radial projections 120 serves in particular to make it easier to assemble the valve, and in particular the hollow sleeve 16 that defines the metering chamber, specifically by providing it with guidance.

Advantageously, the cylindrical body portion 11 of the valve body 10 includes at least one admission opening connected to the receptacle 1 to pass the fluid contained in the receptacle towards the metering chamber 15. Advantageously, the bottom portion (bottom in the position shown in the figures) of the valve body forms a bearing surface for a return spring 8 co-operating with the valve member 20 and urging it towards its rest position.

According to yet another advantageous aspect of the invention, the receptacle 1 advantageously includes a neck 2 provided with a radial flange portion 3 for receiving the top edge portion 13 of the valve body 10, and in particular the bottom axial surface thereof, and also a frustoconical neck portion 5 of shape that corresponds substantially to the frustoconical body portion 12 of the valve body 10. The angle of the frustoconical neck portion 5 going from the radial flange 3 is preferably slightly less than the angle of the frustoconical body portion 12 going from the top edge portion 13. This can be seen more particularly in FIG. 5, but also in FIGS. 1 and 3. This configuration makes it easier to assemble the valve body 10 in the receptacle neck 2 by substantially avoiding contact between the frustoconical portions of the valve body 10 and of the neck 2, in particular while assembling the capsule, and thus while compressing the neck gasket 50. This serves to avoid problems of static indeterminacy that might disturb compression of the gasket. The frustoconical shapes of the receptacle neck 2 and of the valve body 10 greatly limit the dead volume of the device when the valve is assembled on the receptacle. As can be seen in particular in FIG. 1, the filler opening provided in the cylindrical body portion 11 extends substantially to the beginnings of the frustoconical neck and body portions 12 and 5 so that when the valve is turned upside-down (which is its filling position and generally its utilization position), nearly all of the fluid contained in the receptacle 1 can penetrate into the valve body (and thus into the metering chamber 15), and only a very small portion of the fluid cannot be dispensed because of the very small dead volume of the valve of the invention. The present invention thus makes it possible to eliminate the filler ring that is generally provided around the valve body and that is intended specifically to limit the dead volume. Once more, assembly is simplified and cost is reduced.

In another advantageous aspect of the invention, the neck 2 of the receptacle 1, and in particular the frustoconical portion 5 of the neck in the examples shown, may include an outwardly-directed radial shoulder 4 for co-operating with the machine for assembling the fastener capsule 100 on the neck 2, and thus serves as a reference point during said assembly, in particular by crimping, of the fastener capsule 10 on the neck 2 of the receptacle 1. This makes it possible to predetermine the extent to which the neck gasket 50 is compressed while the fastener capsule is being assembled on the neck. Predetermining the compression of the neck in this way serves to reduce variability of compression during assembly and improves the precision of such assembly. Naturally, this outwardly-directed radial shoulder could be made to have a different shape, or it could be provided at a different location, while still performing the same function, i.e. serving as a reference point while the fastener capsule is being assembled on the neck.

Figure 4:
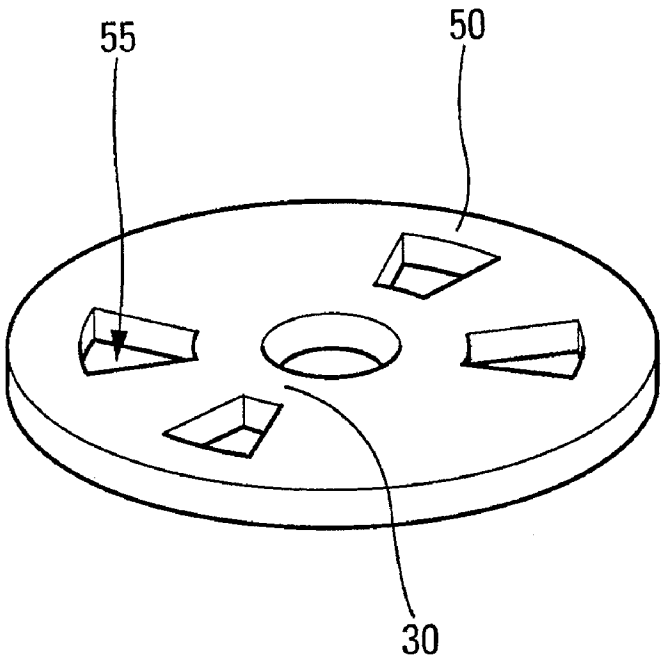
FIG. 4 is a diagrammatic perspective view of the one-piece gasket forming the neck gasket and the top gasket of the metering chamber, in the embodiment of FIG. 3.
Figure 3:
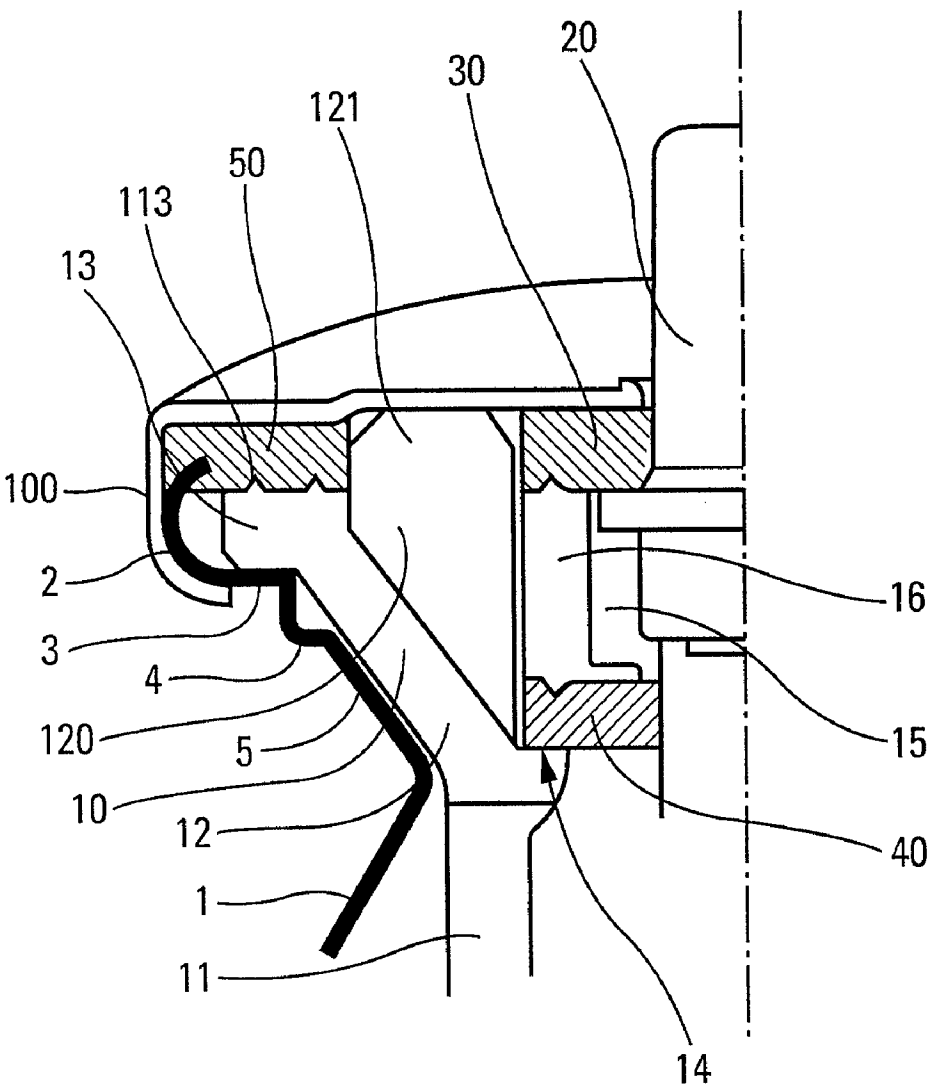
FIG. 3 is a view similar to that of FIG. 1, showing another embodiment of the invention.
Figure 5:
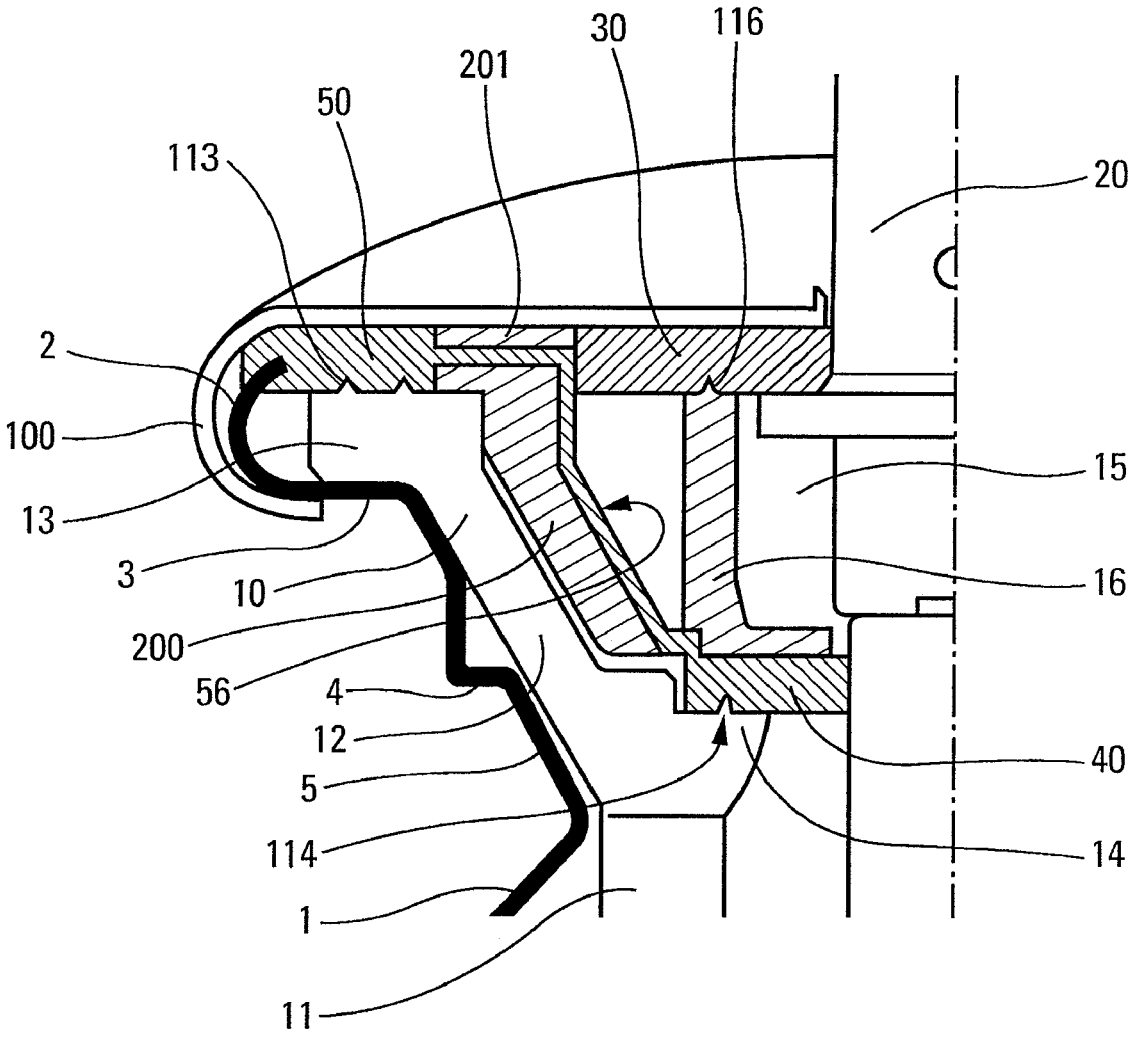
FIG. 5 is a view similar to that of FIGS. 1 and 3, showing yet another embodiment of the invention.

With reference to FIGS. 3 and 4, there can be seen another embodiment of the gasket in accordance with an aspect of the invention. This embodiment differs from the embodiments of FIGS. 1 and 2 in that the gasket forms both the neck gasket 50 and the top gasket 30 of the metering chamber 15 and includes at least one opening 55, and specifically four openings in the example shown. The opening 55 is to allow at least a portion of the valve body 10 to pass therethrough, in particular for passing the top axial edges 121 of the radial projections 120 of the frustoconical body portion 12 after the valve has been assembled. In this embodiment, the radial projections 120 thus extend axially further up than in the embodiment of FIGS. 1 and 2, and they co-operate mechanically with the fastener capsule 100 after assembly so as to form an abutment. This also enhances predetermining compression of the gasket during assembly. In this embodiment, the capsule 100 may optionally have a stepped shape so as to impart different amounts of compression on the neck gasket portion 50 and on the top gasket portion 30 for the metering chamber. Naturally, the number, the shape, and the distribution both of the opening 55 in the gasket and of the radial projections 120 of the valve body can be modified as desired. Similarly, it is possible for only some of the radial projections 120 to have top edges 121 that come into abutment against the capsule 100, if so desired.

With reference to FIG. 5, there is shown another embodiment of the gasket in an aspect of the invention, in which the neck gasket 50 is made integrally with the bottom gasket 40. In the example shown, the neck gasket portion 50 is preferably integrally connected with the bottom gasket portion 40 via at least one bridge of material 56. Advantageously, this one-piece neck gasket 50 integral with said bottom gasket 40 is overmolded on a rigid element 200 that co-operates with the valve body 10. In particular, this rigid element 200 may be partially frustoconical in shape, corresponding substantially to the shape of the frustoconical body portion 12, while preferably avoiding substantially any contact between these frustoconical portions, so as to avoid problems of static indeterminacy. This rigid element 200 is preferably made integrally with the hollow axial sleeve 16 defining the metering chamber 15. The number of parts and costs are thus further reduced. The rigid element 200 may include a radial flange portion 201 co-operating firstly with the top axial surface of the top edge 13 of the valve body, and secondly with the fastener capsule 100, to predefine the compression of the neck gasket 50 during assembly of the capsule 100. Furthermore, in this embodiment, the frustoconical body portion 12 of the valve body 10 may also include radial projections 120 (not shown in FIG. 5).

Although the present invention is described with reference to a plurality of distinct embodiments, it should be understood that the various characteristics shown in the figures should be combined in arbitrary manner with one another. Similarly, certain aspects described above could be implemented independently. For example, the means enabling the amount of compression of the neck gasket during assembly of the fastener member 100 on the receptacle neck, in particular by crimping, could be provided in a valve in which the neck gasket is not necessarily made integrally with one or other of the two metering chamber gaskets. Similarly, the frustoconical shape of the neck and of the valve body could be implemented independently of the one-piece gasket and/or of the means for predetermining the amount of compression.

Furthermore, the person skilled in the art can apply any useful modifications to the embodiments given as examples with reference to the drawings, without thereby going beyond the ambit of the present invention as defined by the accompanying claims.

The invention claimed is:

1. A fluid dispenser valve for mounting on a neck of a receptacle containing fluid, said valve comprising a valve body including a metering chamber and a valve member movable in said metering chamber between a rest position and a dispensing position, said metering chamber having a top gasket and a bottom gasket co-operating in leaktight manner with said valve member, said valve including a neck gasket co-operating in leaktight manner with said valve body and with said receptacle neck, said neck gasket is made integrally as a single piece with said top gasket, and said neck gasket includes at least one opening for passing at least a portion of the valve body, in which said valve body comprises a cylindrical body portion, a top edge portion, and a frustoconical body portion interconnecting said cylindrical body portion and said top edge portion, and each opening, after assembly, has the top axial edge of a radial projection of said frustoconical body portion passing therethrough.

2. A valve according to claim 1, in which the diameter of said top edge portion is greater than the diameter of said cylindrical body portion.

3. A valve according to claim 1, in which said neck gasket co-operates with the outer top axial surface of said top edge.

4. A valve according to claim 3, in which said outer top axial surface of said top edge includes a sealing profile.

5. A valve according to claim 1, in which said bottom gasket is disposed close to the junction between the cylindrical body portion and the frustoconical body portion.

6. A valve according to claim 5, in which said valve body includes an inwardly-directed radial shoulder close to said junction between the cylindrical body portion and the frustoconical body portion.

7. A valve according to claim 6, in which the top axial surface of said radial shoulder includes a sealing profile co-operating with said bottom gasket.

8. A valve according to claim 1, in which said metering chamber comprises a hollow axial sleeve co-operating in leaktight manner with said top and bottom gaskets and defining said metering chamber on its inside.

9. A valve according to claim 1, in which said frustoconical body portion includes at least one inwardly-directed radial projection.

10. A valve according to claim 9, in which said frustoconical body portion includes a plurality of radial projections having internal axial edges defining an inscribed geometrical cylinder of diameter slightly greater than the outside diameter of a hollow axial sleeve defining the metering chamber.

11. A valve according to claim 1, in which said valve includes a fastener member for fastening said valve body on said neck of the receptacle.

12. A valve according to claim 11, in which said fastener member compresses said neck gasket while being assembled on the neck of the receptacle.

13. A valve according to claim 12, in which, after being assembled on the neck of the receptacle, said fastener member co-operates with a rigid portion secured to or integral with said valve body to form an abutment and thus predetermine the amount of compression of said neck gasket during assembly of the fastener member.

14. A valve according to claim 1, in which, after assembly, said fastener member co-operates with the top edge of at least one radial projection.

15. A fluid dispenser device comprising a receptacle containing the fluid, the fluid dispenser device comprising a valve according to claim 1.

16. A device according to claim 15, in which said receptacle includes a neck provided with a radial flange portion for receiving a top edge portion of the valve body and a frustoconical neck portion of shape corresponding substantially to the shape of a frustoconical body portion of the valve body.

17. A device according to claim 16, in which the angle of said frustoconical body portion from said radial flange is slightly smaller than the angle of the frustoconical body portion from said top edge portion in order to facilitate assembling the valve body in the neck of the receptacle.

18. A fluid dispenser valve for mounting on a neck of a receptacle containing fluid, said valve comprising a valve body including a metering chamber and a valve member movable in said metering chamber between a rest position and a dispensing position, said metering chamber having a top gasket and a bottom gasket co-operating in leaktight manner with said valve member, said valve including a neck gasket co-operating in leaktight manner with said valve body and with said receptacle neck, said neck gasket is made integrally as a single piece single piece with said bottom gasket, said neck gasket integral with said bottom gasket is overmolded on a rigid element co-operating with the valve body.

19. A valve according to claim 18, in which said neck gasket is connected integrally with said bottom gasket via at least one bridge of material.

20. The valve according to claim 18, in which said valve body comprises a cylindrical body portion, a top edge portion, and a frustoconical body portion interconnecting said cylindrical body portion and said top edge portion.

21. The valve according to claim 20, in which the diameter of said top edge portion is greater than the diameter of said cylindrical body portion.

22. The valve according to claim 20, in which said frustoconical body portion includes at least one inwardly-directed radial projection.

23. The valve according to claim 18, comprising a fastener member for fastening said valve body on said neck-of the receptacle.

24. A fluid dispenser device comprising a receptacle containing the fluid, the fluid dispenser device comprising a valve, said valve comprising a valve body-including a metering chamber and a valve member movable in said metering chamber between a rest position and a dispensing position, said metering chamber having a top gasket and a bottom gasket co-operating in leaktight manner with said valve member, said valve including a neck gasket co-operating in leaktight manner with said valve body and with said receptacle neck, said neck gasket is made integrally as a single piece with one of said top and bottom gaskets of the metering chamber;

said receptacle includes a neck provided with a radial flange portion for receiving a top edge portion of the valve body, and a frustoconical neck portion of shape corresponding substantially to the shape of a frustoconical body portion of the valve body; and in which said frustoconical neck portion includes an outwardly-directed radial shoulder serving as a reference point during assembly of a fastener member on the neck of the receptacle, by crimping.

25. A device according to claim 24, in which said radial shoulder enables the amount of compression of said neck gasket to be predetermined during assembly of the fastener member on the neck of the receptacle.

* * * * *